US006471209B1

(12) United States Patent
Barshinger

(10) Patent No.: US 6,471,209 B1
(45) Date of Patent: Oct. 29, 2002

(54) RACING CAR BOARD GAME

(76) Inventor: Jeffrey A Barshinger, 663 S. Hampton at Waterford, York, PA (US) 17402

( * ) Notice: Subject to any disclaimer, the term of this patent is extended or adjusted under 35 U.S.C. 154(b) by 0 days.

(21) Appl. No.: 09/630,239

(22) Filed: Aug. 1, 2000

(51) Int. Cl.[7] ..... A63F 3/00
(52) U.S. Cl. ..... 273/246; 273/259; 273/277
(58) Field of Search ..... 273/242, 243, 273/244, 246, 259, 288, 285, 277

(56) References Cited

U.S. PATENT DOCUMENTS 3,897,064 A * 7/1975 Sonnabend
4,042,245 A 8/1977 Zarour
4,357,017 A * 11/1982 Schneider
4,624,463 A 11/1986 Glennon
4,749,582 A 6/1988 Fritz et al.
5,114,152 A * 5/1992 Rouse
5,322,293 A * 6/1994 Goyette
5,350,178 A * 9/1994 Hollar
5,551,698 A * 9/1996 Lyon
5,934,673 A * 8/1999 Telarico
6,095,522 A * 8/2000 Spell

* cited by examiner

*Primary Examiner*—Benjamin H. Layno
*Assistant Examiner*—Vishu K Mendiratta
(74) *Attorney, Agent, or Firm*—Michael I. Kroll

(57) ABSTRACT

The present invention 10 discloses a board game 11 which simulates an automobile race track 12 and race. The game has a number of playing pieces 18 in the form of cars and a board 11 having an image of an oval shaped race track 12 being divided into a plurality of lanes 14 and the lanes being divided into a number of squares 16 being of sufficient size to accommodate the car playing pieces 18. The track 12 has a pit lane 26 having an entrance point and an exit point on the oval track and having fewer squares between the entrance and the exit in the pit lane 26 than between the entrance and the exit on the oval track 12. In addition, the track racing car board game has a pair of advancement dice 28, a pit entrance die 29, a plurality of special advancement dice 36 and a deck of instruction cards.

1 Claim, 9 Drawing Sheets

RACING CAR BOARD GAME

BACKGROUND OF THE INVENTION

1. Field of the Invention

The present invention relates generally to board games and, more specifically, to a track racing car board game having a number of playing pieces in the form of cars and a board having an image of an oval shaped race track being divided into a plurality of lanes and the lanes being divided into a number of squares being of sufficient size to accommodate the car playing pieces. The track has a pit lane having an entrance point and an exit point on the oval track and having fewer squares between the entrance and the exit in the pit lane than between the entrance and the exit on the oval track. In addition, the track racing car board game has a pair of advancement dice, a pit entrance die, a plurality of special advancement dice and a deck of instruction cards.

2. Description of the Prior Art

There are other locator/proximity devices designed to locate and monitor a child location. Typical of these is U.S. Pat. No. 5,640,147 issued to Chek et al. on Jun. 17, 1997.

Another patent was issued to Musa on Sep. 17, 1996 as U.S. Pat. No. 5,557,259. Yet another U.S. Pat. No. 5,646,593 was issued to Hughes et al. on Jul. 8, 1997 and still yet another was issued on Nov. 18, 1997 to Traxler as U.S. Pat. No. 5,689,240.

A game in which playing pieces are advanced incrementally along a track. The track is divided into individual segmented lanes. Alternating segments of each lane are color coded to correspond to the color of game controlled dice. The uncolored segments are identified by numerals. A raised rib separates the game board into the track area and a central zone. Dice are rolled in the central zone. Each playing piece is moved a number of segments corresponding to the number exhibited on the upward face of the corresponding to the number exhibited on the upward face of the corresponding color coded die.

Indy class 500 is a board game for entertainment. Two or more players may participate in the game. The physical limit of participants is eight players. The object of the game is for one of the participants to be first in completing twenty laps around the game board course. Obstructions are provided in the game to cause participants uncalculable obstacles in completing the twenty laps. The game board identifies the participants' actions. It is divided into twenty-five numbered sections. Each section instructs the participants in what to do. Each participant selects a small race car facsimile which is used as his marker. The markers are advanced in turn by throwing of dice, which determines the number of sections the participants may advance. The game also educates the participants with historical facts relating to motor racing.

A method of playing a race game apparatus that includes a game board having an endless loop track divided into a plurality of lanes. Each lane is divided into a plurality of spaces, the spaces being differentiated into at least card spaced and lane changes spaces. There are a plurality of action cards that direct the players to take certain actions, and a playing piece for each player. Each player takes a turn moving his or her playing piece around the spaces in a lane of the track. No player's playing piece is allowed to pass over another player's playing piece in the same lane. The player draws an action card if at the end of the turn the player's playing piece is on a card space, and the player has the option of changing lanes if at the end of the player's turn the player's playing piece is on a lane change space. Play continues until one player has traversed the track a predetermined number of times.

A board game simulating an automobile race for one or more players includes a flexible game board with a first race track depicted on one side and a second, generally smaller, track on the opposite side. A textured track surface on preferred embodiments enables playing cars to remain in place if the flexible game board is placed on uneven or banked support surfaces to simulate real-life tracks. A plurality of charts determine the course and type of movement along either track, responsive to the roll of one or more dice, each die being of a distinct color to indicate a specific chart. Novel rules for playing requires decision making and strategy, thus creating a realistic environment of racing, changing with each play of the game.

While these racing car board games may be suitable for the purposes for which they were designed, they would not be as suitable for the purposes of the present invention, as hereinafter described.

SUMMARY OF THE PRESENT INVENTION

The present invention discloses a board game which simulates an automobile race track and race. The game has a number of playing pieces in the form of cars and a board having an image of an oval shaped race track being divided into a plurality of lanes and the lanes being divided into a number of squares being of sufficient size to accommodate the car playing pieces. The track has a pit lane having an entrance point and an exit point on the oval track and having fewer squares between the entrance and the exit in the pit lane than between the entrance and the exit on the oval track. In addition, the track racing car board game has a pair of advancement dice, a pit entrance die, a plurality of special advancement dice and a deck of instruction cards.

A primary object of the present invention is to provide a novel board game for one or more players simulating racing. Another object of the present invention is to provide a car racing board game using miniaturized racing cars, a number of color-coded dice, and a plurality of instruction cards.

Yet another object of the present invention is to provide a car racing board game using miniaturized racing cars using a number of color-coded dice to determine the number of spaces to be advanced.

Still yet another object of the present invention is to provide a car racing board game using miniaturized racing cars and a number of color coded dice to determine the number of spaces to be advanced and when to select an instruction card.

Additional objects of the present invention will appear as the description proceeds.

The present invention overcomes the shortcomings of the prior art by providing a track racing car board game having a number of playing pieces in the form of cars and a board having an image of an oval shaped track divided in a plurality of lanes and squares being of sufficient size to accommodate the car playing pieces. The cars are placed on a starting position and are moved around the board in turn by each player rolling dice and advancing a number of squares and additionally drawing instruction cards based on the dice having the same number on the top surface after being rolled by the player and by following the instruction printed on the card. Additionally there is provided a black cube having one green side which is rolled along with the advancement dice which determines whether a vehicle must proceed directly to the pit lane and a red set of dice which are used according to the instructions printed on one or more of the instruction cards.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

Should a player roll any doubles other than 6's, the player draws an instruction card from the top of the deck and follows the instruction imprinted thereon. If the player rolled double 6's then they will roll the red dice, select a vehicle and advance the selected vehicle that number of spaces.

Figure 3:
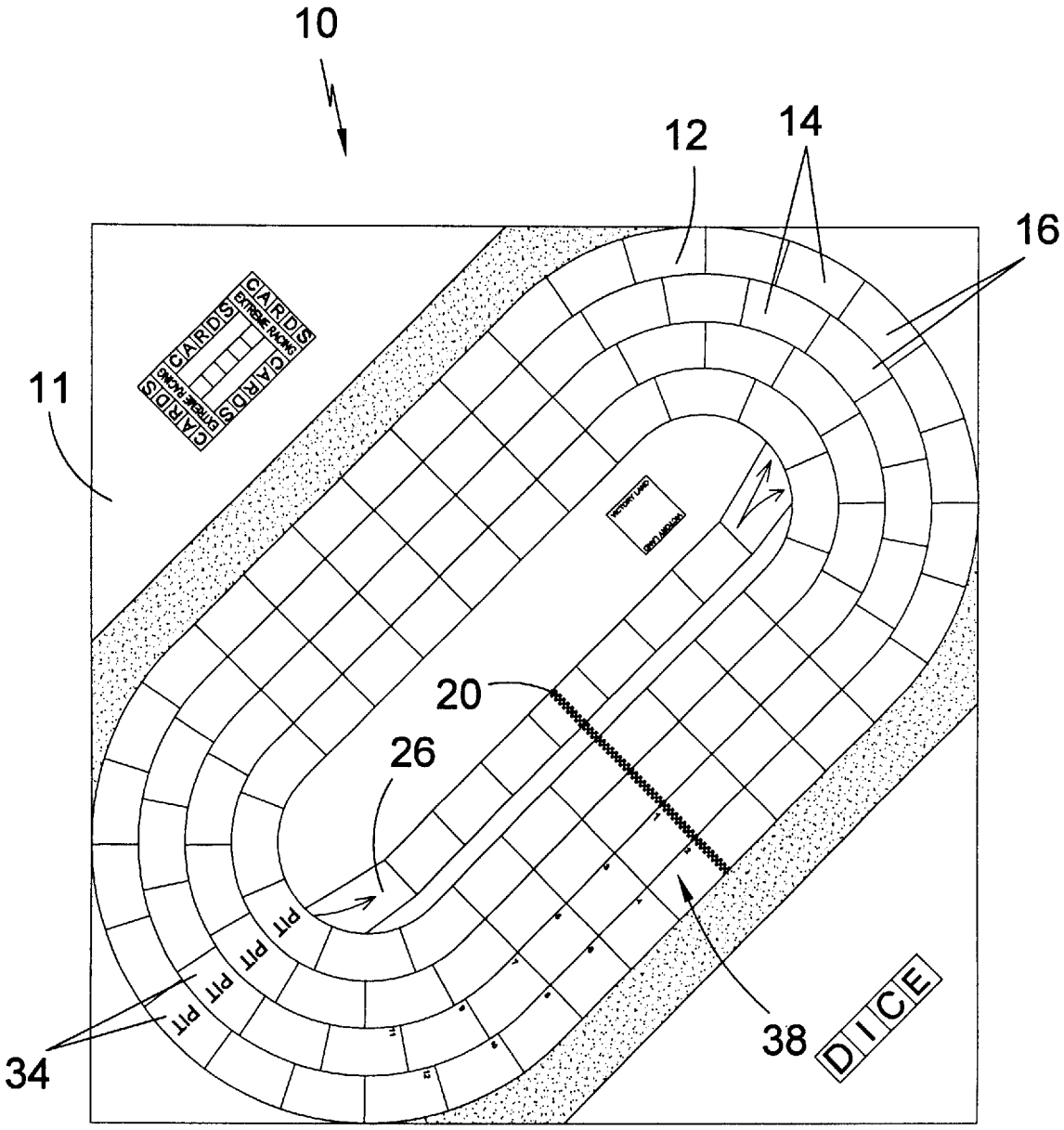

FIG. 3 is a top plan view of the game board of the present invention having an image of an oval race track wherein said image is divided into a number of lanes and wherein each lane is further divided into a plurality of squares. Also shown are a number of squares having the word pit imprinted thereon leading to a section of track referred to as the pit lane which has two squares at one end having an arrow imprinted on each. Also shown are a number of squares having an imprint which when passed designates the completion of one lap which is recorded on a score sheet for that player.

Figure 4:
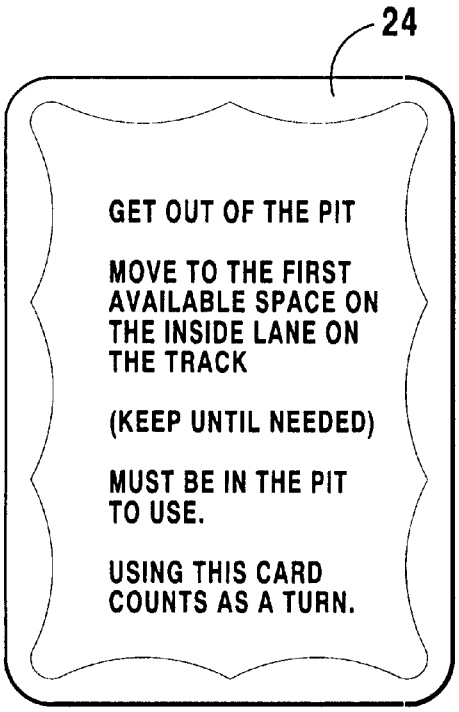
Figure 4A:
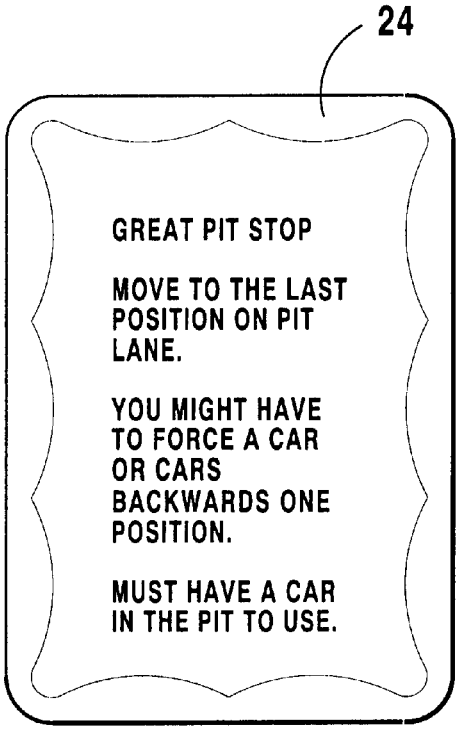
Figure 4B:
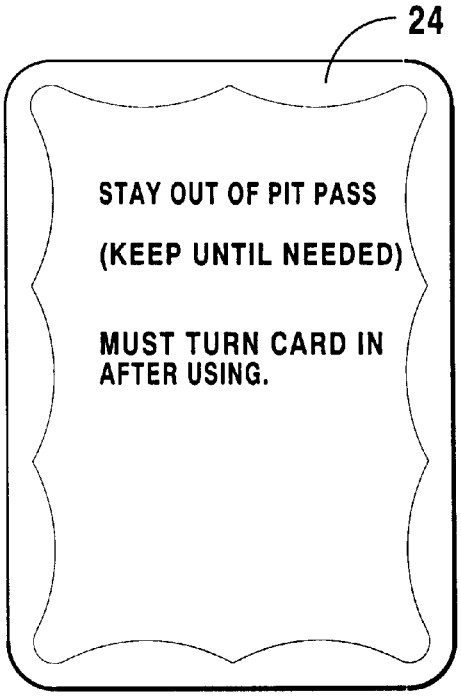
Figure 4C:
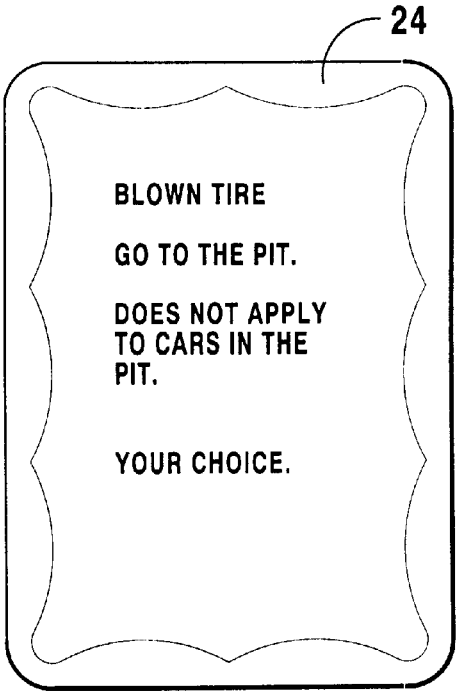
Figure 4D:
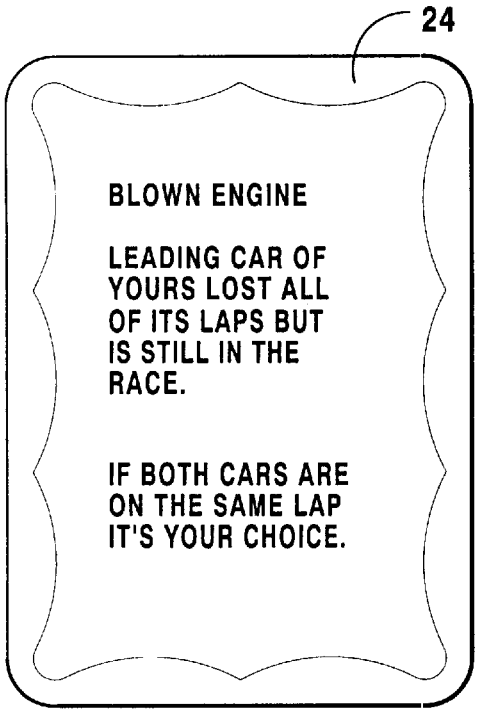
Figure 4E:
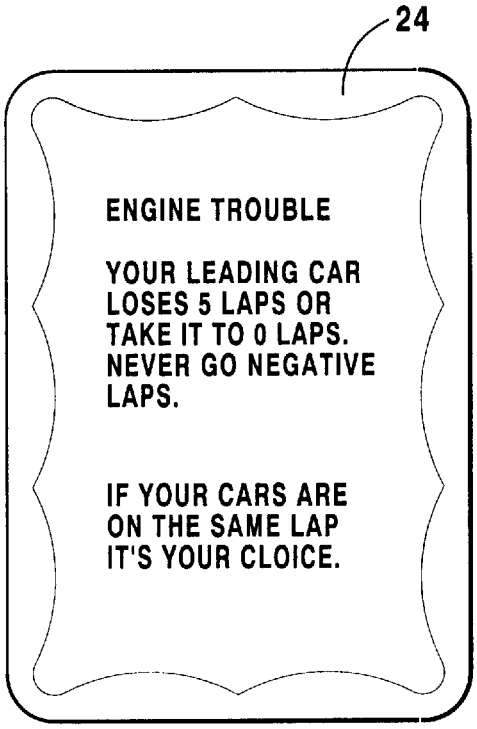
Figure 4F:
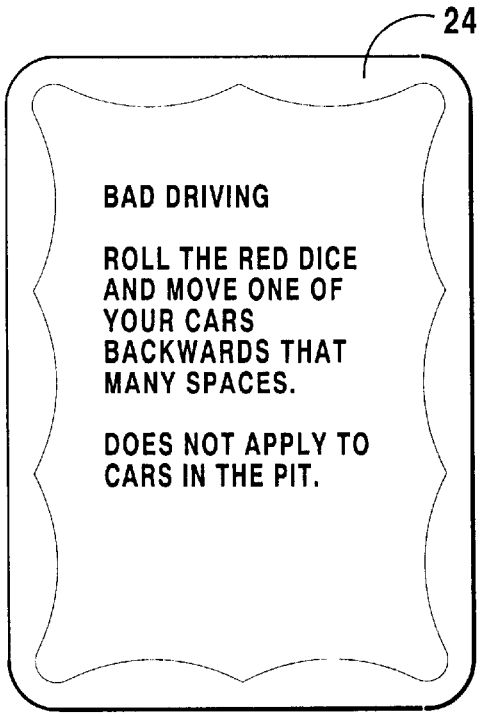
Figure 4G:
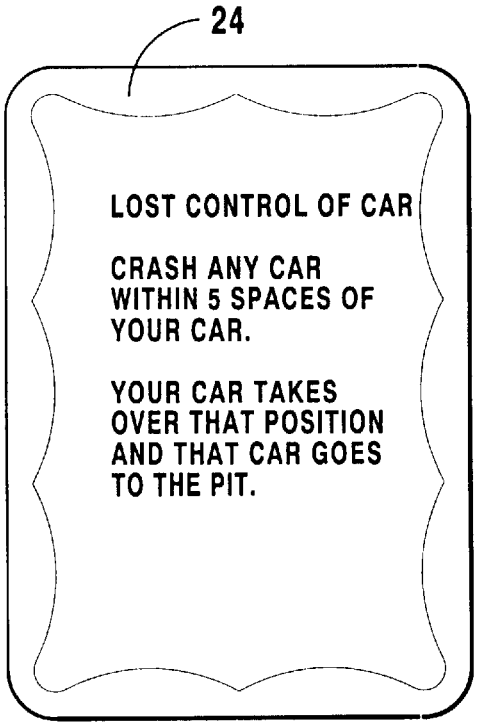
Figure 4H:
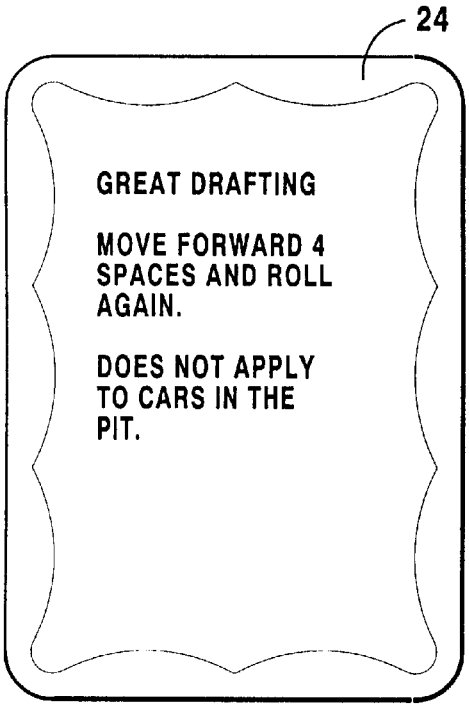
Figure 4I:
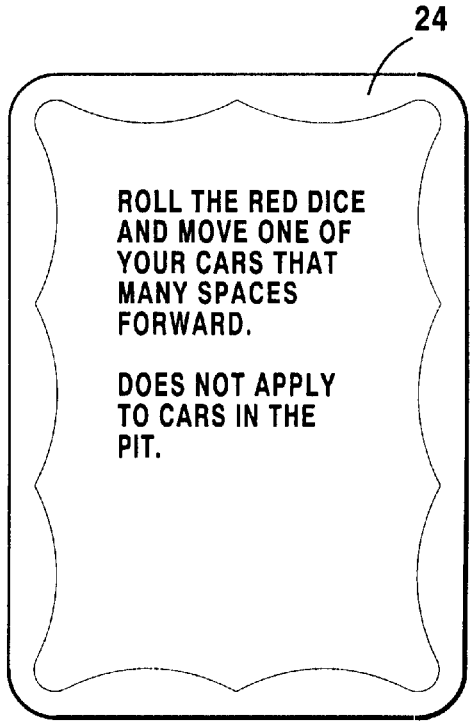
Figure 4J:
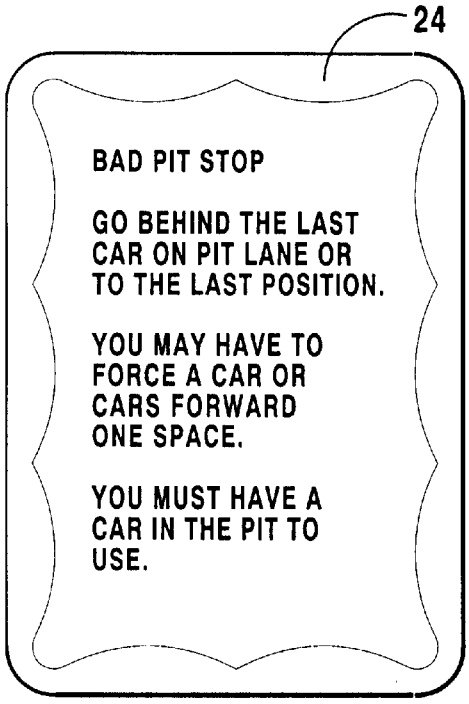
Figure 4K:
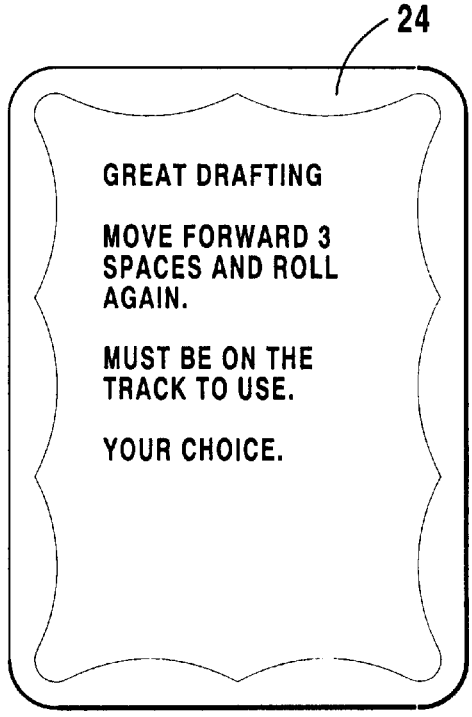
Figure 4L:
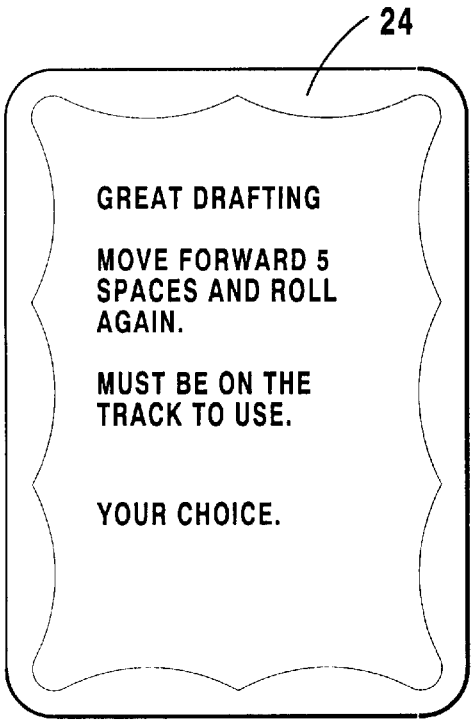
Figure 4M:
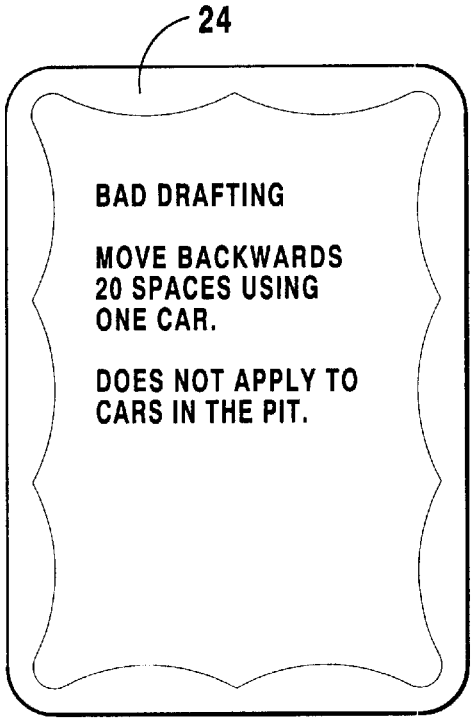
Figure 4N:
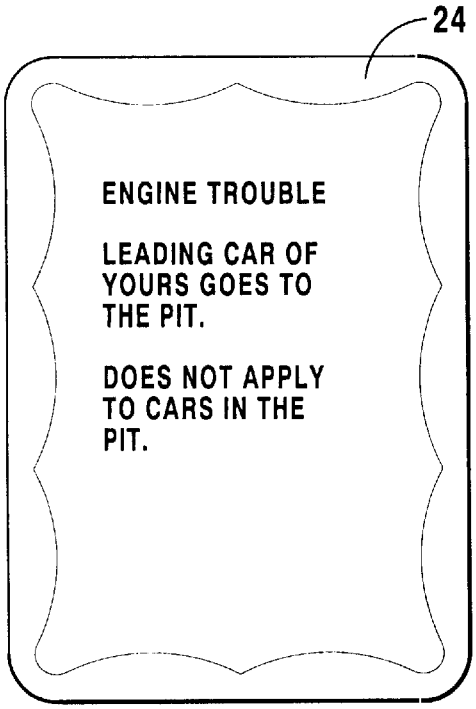
Figure 4O:
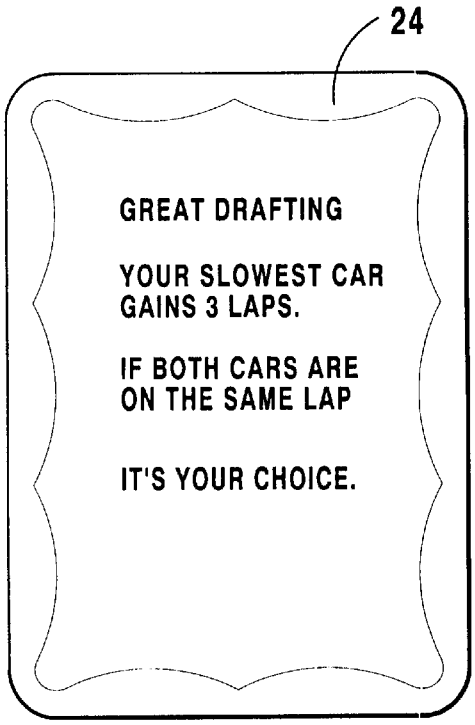
Figure 4P:
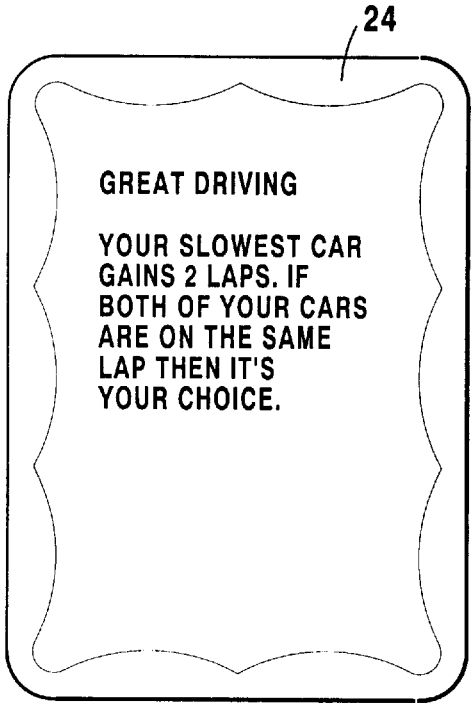
Figure 4Q:
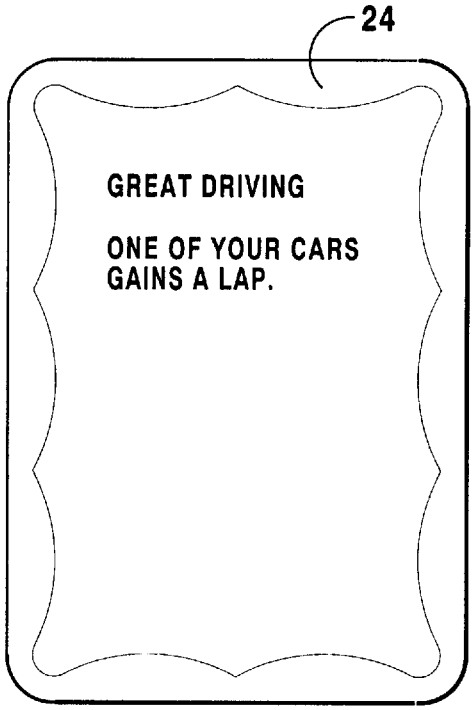
Figure 4R:
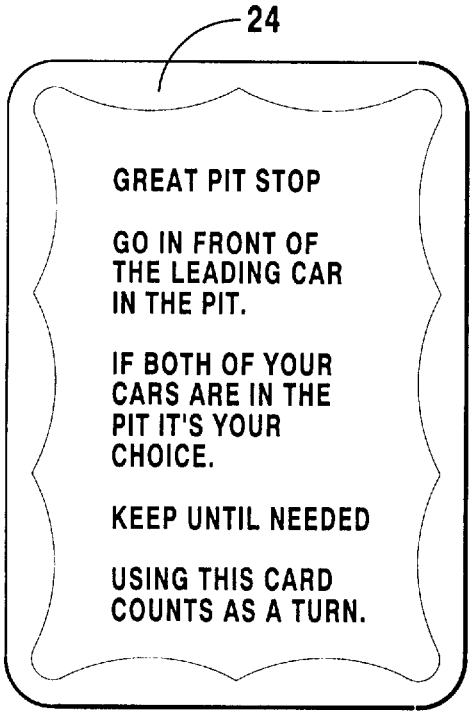
Figure 4S:
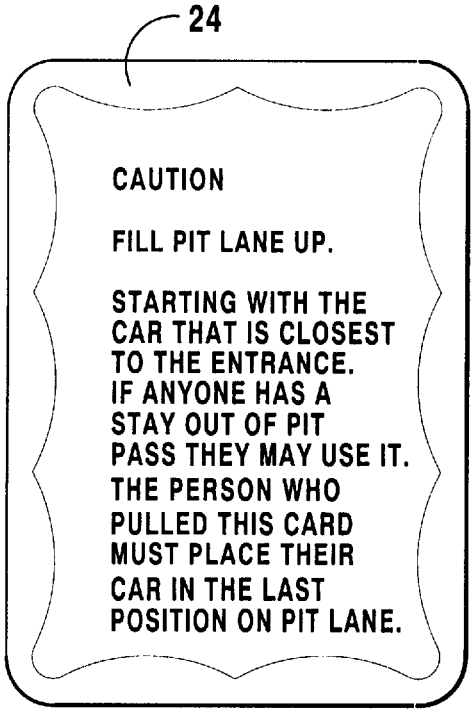
Figure 4T:
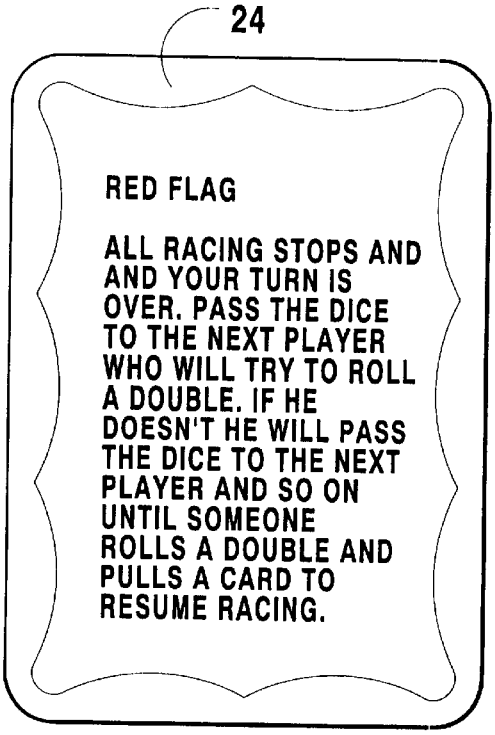
Figure 4U:
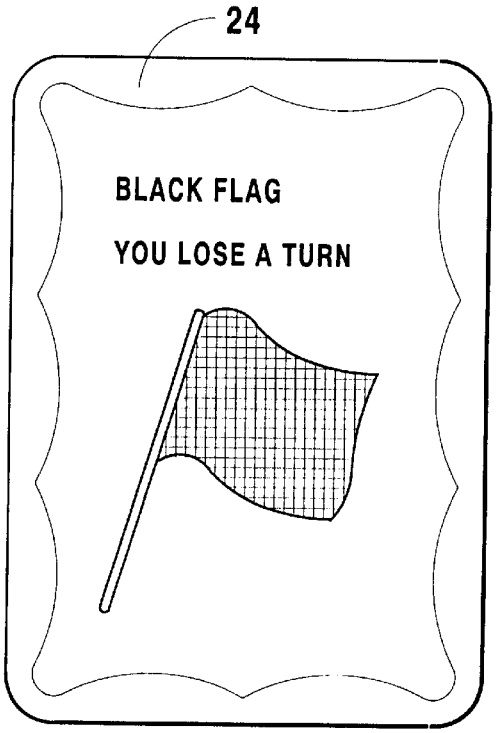

FIGS. 4–4U is a front elevation of the instruction cards of the present invention wherein one or more of said cards forms the deck of instruction cards which is drawn from by the players based on a player throwing the black die and wherein the single green side lands facing up whereupon a player takes one instruction card from the top of the deck and follows the instruction imprinted thereon.

LIST OF REFERENCE NUMERALS

With regard to reference numerals used, the following numbering is used throughout the drawings.

10 present invention
11 game board
12 race track
14 lane
16 square
18 playing piece
20 starting point
22 dice
24 instruction card
26 pit lane
28 white dice
29 black die
30 green surface
32 die dimples
34 pit squares
36 red dice
38 starting grid

DESCRIPTION OF THE PREFERRED EMBODIMENT(S)

In order that the invention may be more fully understood, it will now be described, by way of example, with reference to the accompanying drawings in which FIGS. 1 through 4U illustrate the present invention being a racing car board game.

Figure 1:
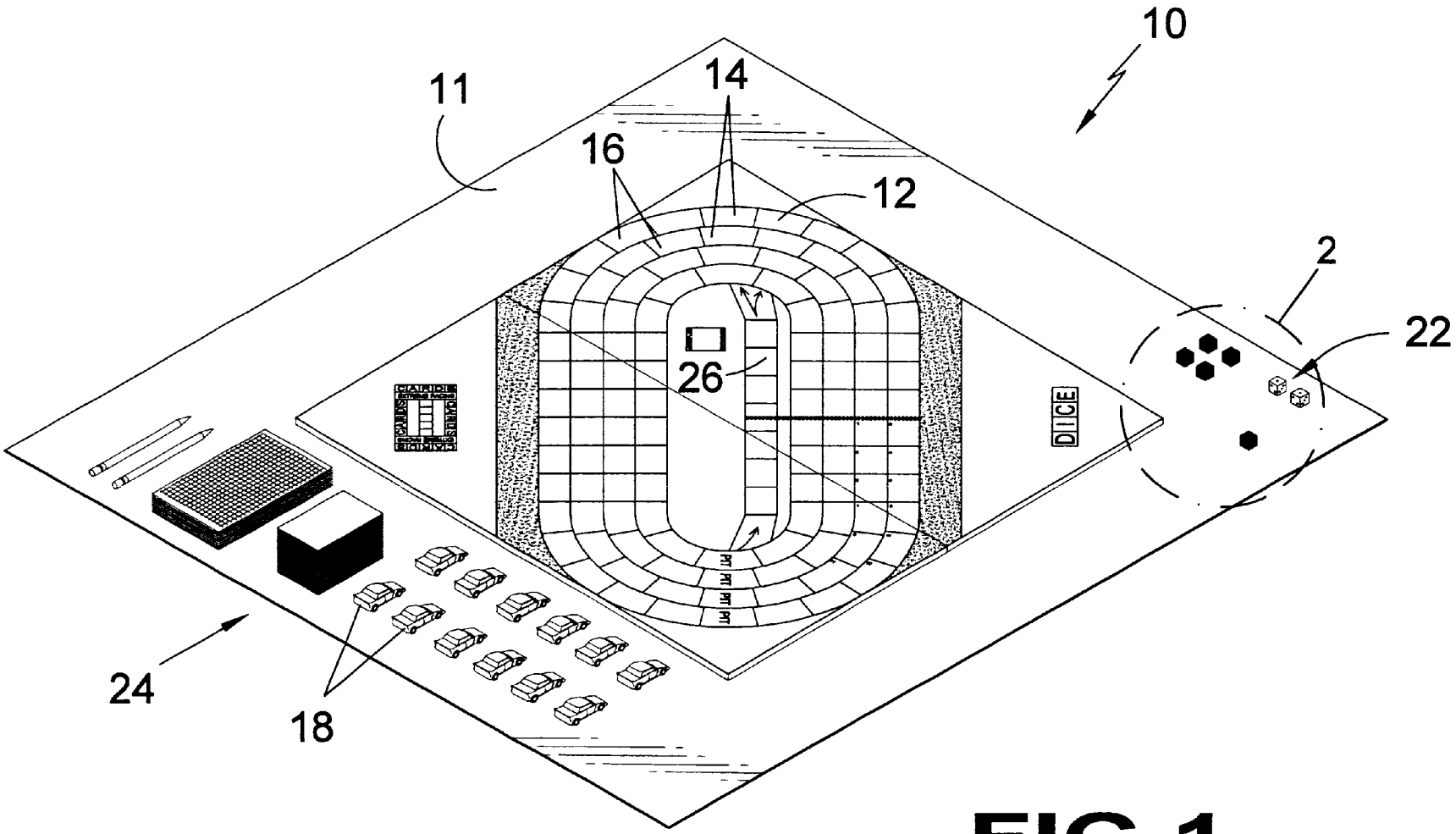
FIG. 1 is a perspective view of the present invention. Shown is a board game having an image of an oval race track wherein said image is divided into a number of lanes and wherein each lane is further divided into a plurality of squares, whereupon a number of players place one or more playing pieces resembling miniature racing cars at a starting point and advances their game pieces, when their turn occurs, based on a number of color coded dice and/or instruction cards. The winner of the game is determined by the player whose game piece or pieces completes the number of laps agreed upon by the players before the game is started.

Turning to FIG. 1, shown therein is a perspective view of the present invention 10. Shown is a board game 11 having an image of an oval race track 12 wherein the image is divided into a number of lanes 14 and wherein each lane is further divided into a plurality of spaces or squares 16, whereupon a number of players place one or more playing pieces 18 resembling miniature racing cars at a starting point 20 and advances their game pieces 18, when their turn occurs, based on a number of color coded dice 22 and/or instruction cards 24. The winner of the game is determined by the player whose game piece 18 or pieces completes the number of laps agreed upon by the players before the game is started. Pit lane 26 is also shown.

Figure 2:
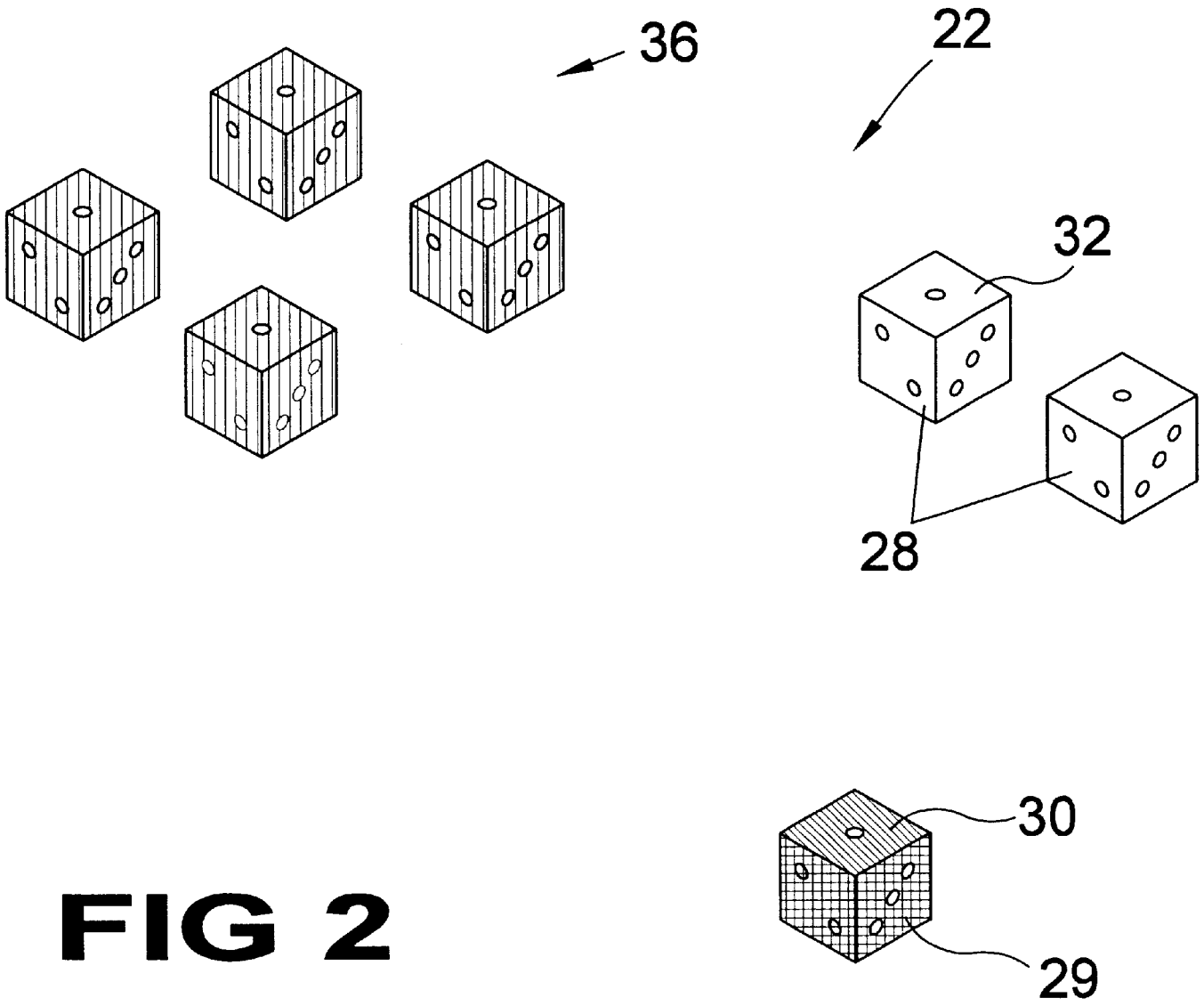
FIG. 2 is an enlarged view of the color coded dice used in the game to determine the number of spaces to be advanced by a player, whether a player is to draw an instruction card, and whether a car is to be placed in the pit lane. Shown are a set of white dice and a single black die, which are rolled by each player, in turn, onto the game board. The player adds up the dimples displayed on the top side of the white dice and advances one or more playing pieces that number of spaces. Should the black die, having also been rolled, have the green side on top, then the player moves their closest vehicle to the first space in pit lane. Should that space be occupied then that vehicle and all vehicles in the immediate spaces in front of said vehicle are to be moved forward one space therein allowing the current player to place his vehicle in the first space of pit lane.

Turning to FIG. 2, shown therein is an enlarged view of the color coded dice 22 used in the game to determine the number of spaces 16 to be advanced by a player, whether a player is to draw an instruction card 24, and whether a car 18 is to be placed in the pit lane. Shown are a set of white dice 28 and a single black die 29, which are rolled by each player, in turn, onto the game board. The player adds up the dimples 32 displayed on the top side of the white dice 28 and advances one or more playing pieces that number of spaces 16. Should the black die 29, having also been rolled, have the green side 30 on top, then the player moves their closest vehicle 18 to the first space in pit lane 26. Should that space be occupied then that vehicle 18 and all vehicles in the immediate spaces in front of the vehicle are to be moved forward one space therein allowing the current player to place his vehicle in the first space of pit lane 26.

Should a player roll any double numbers on the dice other than 6's, the player draws an instruction card 24 from the top of the deck and follows the instruction imprinted thereon. If the player rolls double 6's, then that player will roll the two pair of red dice 36, select a vehicle and advance the selected vehicle that number of spaces 16.

Turning to FIG. 3, shown therein is a top plan view of the game board 11 of the present invention 10 having an image of an oval race track 12 wherein the image is divided into a number of lanes 14 and wherein each lane is further divided into a plurality of squares 16. Also shown are a number of squares 34 having the word pit imprinted thereon leading to a section of track referred to as the pit lane 26 which has one square at each end having an arrow imprinted on each. The pit lane 26 has fewer squares 34 than either the front or rear straightway. Also shown are a number of squares having an imprint 20 being the start/finish line which when passed designates the completion of one lap which is recorded on a score sheet for that player. Also shown is the starting grid 38 numbered 1–12 for receiving vehicles.

Turning to FIGS. 4–4U, shown therein is a front elevation of the instruction cards 24 of the present invention wherein one or more of the cards forms the deck of instruction cards which is drawn from by the players based on a player throwing the black die 29 and wherein the single green side 30 lands facing up whereupon a player takes one instruction card 24 from the top of the deck and follows the instruction imprinted thereon.

What is claimed to be new and desired to be protected by Letters Patent is set forth in the appended claims:

1. The method of playing a racing car game comprising the steps of:

a) forming a game board, said game board being substantially planar defined by a topside and an underside, said game board being substantially square shaped, a generally oval shaped race track defined on said topside of said game board, said race track substantially aligned along a diagonal of said game board and having a plurality of defined lap lanes depicted thereon, said lap lanes being contiguous to each other, said race track having a front and rear straightway, and a pit lane located adjacent a straightway, and said lap lanes divided into spaces for receiving and moving play pieces, some of the spaces in said lap lanes being designated with a term requiring entrance into said pit lane;

b) placing color coded play pieces shaped like racing cars on a starting grid made up of a plurality of spaces along one or more of said lap lanes behind a starting line;

c) each player in turn rolling a pair of dice of one color to determine how many spaces a racing car is to be moved along a lap lane and also rolling a single die of second color with one side of a third color, and if the side with the third color comes out on top said racing car is moved to a space in the pit lane;

d) if the player roll said pair of dice of said one color and obtains a pair of numbers other than a designated pair of numbers, the player will select an instruction card from a deck of instructions cards; and e) if the player rolls said pair of dice of said one color and obtains said designated pair of numbers then the player will roll two pair of dice of a fourth color and will move said racing car along the number of spaces indicated by said two pair of dice said forth color.

* * * * *